US005520345A

United States Patent [19]

Teich et al.

[11] Patent Number: 5,520,345

[45] Date of Patent: May 28, 1996

[54] TEXTILE MACHINE WITH PRODUCT TRANSPORT APPARATUS

[75] Inventors: Udo Teich, Schulstasse; Detlef Hammerschmidt, Buchenweg, both of Germany

[73] Assignee: Barmag AG, Remscheid, Germany

[21] Appl. No.: 279,432

[22] Filed: Jul. 25, 1994

[30] Foreign Application Priority Data

| | | | |
|---|---|---|---|
| Jul. 24, 1993 | [DE] | Germany | 43 25 381.4 |
| May 2, 1994 | [DE] | Germany | 44 15 317.1 |
| Jun. 23, 1994 | [DE] | Germany | 44 21 892.3 |

[51] Int. Cl.[6] ..... B65H 54/02; D01H 9/10

[52] U.S. Cl. ..... 242/35.5 A; 57/281

[58] Field of Search ..... 242/35.5 A; 57/281, 57/90

[56] References Cited

U.S. PATENT DOCUMENTS

| | | | |
|---|---|---|---|
| 3,895,725 | 7/1975 | Mayer | 57/281 X |
| 3,987,974 | 10/1976 | Mayer | 242/35.5 A |
| 4,023,339 | 5/1977 | Laderach et al. | 57/281 |
| 4,079,898 | 3/1978 | Murakami et al. | 242/35.5 A |
| 4,669,942 | 6/1987 | Nagasawa | 242/35.5 A X |
| 4,923,132 | 5/1990 | Hirai et al. | 242/35.5 A |
| 4,979,360 | 12/1990 | Kallmann et al. | 57/281 |
| 5,010,725 | 4/1991 | Yasui et al. | 57/281 |
| 5,244,160 | 9/1993 | Hinchliffe et al. | 242/35.5 A |
| 5,292,081 | 3/1994 | Langen et al. | 242/35.5 A |
| 5,337,967 | 8/1994 | Teich et al. | 242/35.5 A |
| 5,350,128 | 9/1994 | Deters et al. | 242/35.5 A |
| 5,365,728 | 11/1994 | Mack | 242/35.5 A X |

FOREIGN PATENT DOCUMENTS

| | | | |
|---|---|---|---|
| 0560278 | 9/1993 | European Pat. Off. | 242/35.5 A |
| 62-31671 | 2/1987 | Japan | 242/35.5 A |
| 6-127837 | 5/1994 | Japan | 242/35.5 A |

*Primary Examiner*—Michael R. Mansen
*Attorney, Agent, or Firm*—Bell, Seltzer, Park & Gibson

[57] ABSTRACT

The present invention relates to a textile machine for producing/processing yarns, in which the empty tubes and full yarn packages are transported by a product transport system which includes a guideway for the product conveying devices, and a separate overhead rail which supports a tractor drive unit. The tractor drive unit may be coupled to either end of the product conveying devices by an elongate chain, which permits the product conveying devices to be moved onto and from said tracks which extend along an aisle along the front of the textile machine.

24 Claims, 6 Drawing Sheets

TEXTILE MACHINE WITH PRODUCT TRANSPORT APPARATUS

BACKGROUND OF THE INVENTION

This invention relates to a textile machine for producing and/or processing yarns with a plurality of production or processing stations arranged side by side in the longitudinal direction of the machine, with a yarn winding unit being associated with each station, and further including a transport system for transporting empty tubes or full yarn packages to or from the winding units, the transport system comprising an electric overhead conveyor traveling along a guideway or track system of the type of a rail.

A textile machine of the described type is disclosed in DE-OS 21 23 689 and corresponding U.S. Pat. No. 3,895,725. In this prior machine, the transport device comprises in its longitudinal direction several carriages of an electric overhead conveyor. The joined carriages may correspond in their length and in accordance with the yarn packages deposited thereon to one section each of processing stations. The carriages are pulled by a power drive of the electric overhead conveyor, so that continuously circulating drive means are not needed, since they may greatly interfere, require energy even when idle, and be subjected to wear. Each of these carriages forms a transport container for a yarn package transport device into the textile machine, stationary additional drives are provided in the region of guiding or receiving devices, so as to cause the package transport devices to enter into or move out of the transport container, it being possible to construct these drives in particular as frictional drive wheels. While this known package transport device already permits travel along relatively narrow curves and reduces the space needed when packages are buffered or temporarily stored, the space utilization is not yet optimal, inasmuch as the package transport devices or the axially extending support beams used for this purpose restrict a further narrowing of the curves. Furthermore, it is possible to maintain the flow of material, in particular the transfer of the empty tubes to the processing machines, only by means of a plurality of additional drives which are susceptible to breakdown, and a correspondingly complicated control system.

It is further provided that, for purposes of receiving the full yarn packages, the electric overhead conveyor moves into the machine aisles of the respective processing stations, whereby high costs are incurred for switches and laying the necessary overhead contact wires.

It is therefore the object of this invention to provide an improved textile machine of the described type, so as to simplify the material flow from and to each processing station substantially without incurring additional expenses for carriage drives.

SUMMARY OF THE INVENTION

The above and other objects and advantages of the present invention are achieved by the provision of a textile apparatus which comprises a textile machine having a plurality of yarn winding stations positioned in a side-by-side arrangement extending in a longitudinal directional along a front face of the machine, a product transport system for transporting products to or from the winding stations of the textile machine and comprising a) a guideway having a portion thereof extending along the front of the textile machine, b) a product carrying device mounted for movement along the guideway, c) an overhead rail extending adjacent and parallel to at least a portion of the length of the guideway, d) a tractor drive unit mounted for powered movement along the overhead rail, and e) a coupling unit for releasably coupling the tractor drive unit to the product carrying device.

In a preferred embodiment, the product carrying device may be constructed as a chain link element conveyor which travels along the guideway. Also, the chain link element conveyor may be a chain link train. For this reason these terms are used synonymously therein.

The use of the described type of transport system allows additional, stationary drives for delivering empty tubes to, or for removing full yarn packages from the processing stations of the textile machine to be omitted, since the tractor drive unit itself moves the carrying devices or the chain link train, which receive the yarn packages, to each processing station. Thus, a particularly economically operating and cost-favorable transport system for a textile machine is created. If need arises, the chain link train permits a variable suspension of the carrying devices, it being possible to arrange the packages closely adjoining one another on the carrying devices. The suspended carrying devices are also described as hanging carriages. Each of the carrying devices forms a frame for accommodating an adequate number of package mandrels or receiving grooves, which can receive the full yarn packages or the empty tubes, or on which the full yarn packages or empty tubes are to be deposited. The number of package mandrels or receiving grooves corresponds essentially to the number of winding spindles of one machine side. It is especially advantageous to construct the chain link train as an articulated link chain, in particular a Cardan joint chain, since it allows to make the possible curve radii of the guideway system very narrow. Furthermore, the use of a Cardan joint chain results in a reduced risk that the individual chain links wedge into one another when moving in the opposite direction, i.e. during a pushing motion, which could lead to a breakdown of the operation.

In a particularly cost-favorable embodiment of the transport system, the rail for the electric overhead conveyor, which includes the tractor drive unit, is designed as a circular course in which switching elements are absent, and the second separate guideway for the chain link train includes a main track extending parallel to the rail of the drive unit, and a number of side tracks which diverge from the circular course. Thus, the side tracks diverging from the main track serve to transport the yarn packages from the respective processing stations or to transport empty tubes to the processing stations. These side tracks are connected via switches with the main track. The switches are each located at the end of a machine aisle, where the main track of the guideway system crosses. Thus, a switch is associated to each machine aisle, each switch is arranged to terminate in the main travel direction of the tractor drive unit on its rail. Although each switch can be controlled by a motor, air pressure, or other means, it will however also suffice, when out of two successive switches only that one is controllable which is in each instance the first to be operative oppositely to the main travel direction. The second switch is set, for example, by a spring, to its branch-off position, and can therefore be pushed by the chain link train against the force of the spring in the main travel direction.

Each side track of the separate guideway may be provided not only as a transport path from or to a processing station, but it may also be used as a "parking possibility" of the chain link train carrying the yarn packages or empty tubes. In a further embodiment, an additional track section serving to "park" the yarn packages may also be constructed as a turning or looping track. It is preferred to provide the turning track outside of the machine area. If need arises, the electric overhead conveyor travels around it along its circular course. This allows to pick up again the chain link element conveyor from the other end after a corresponding coupling. In this manner, it is possible to turn the package mandrels from one end to the other, when related to the direction of entering into the machine aisle. This will be useful, for example, for servicing the A and B sides of the textile machine, since in this instance it is possible to service both machine sides with a single transport system. Such a turning loop may likewise be provided, so as to be able to deliver the yarn packages from the hanging carriages always toward the same side.

To supply the processing stations in the respective machine aisles, the electric overhead conveyor travels along its circular course, and in so doing, it pulls the coupled chain link train along the main track of the guideway extending parallel to its circular course, until a switch is passed which leads to a specific machine aisle. The switch tongue abutting in this process by the force of a spring is forcibly opened, and upon the passage of the last chain link, returns to its divergent position. Thereafter, the travel direction is reversed, so that the chain link train is caused by the corresponding setting of the switch to move into this machine aisle.

Considering the fact that the length of a machine aisle is greater than the spacing between two successive switches, which lead each into one of two successive machine aisles, this may result in that, while the rear end of the chain link element conveyor has passed the switch of the machine aisle to be serviced, the front end of the chain link element conveyor has however passed already the switch of the following machine aisle.

In this instance, it is proposed to keep the switch of the following machine aisle open via a controllable switch actuating mechanism, while the switch of the machine aisle to be serviced can automatically stay in its branch-off position, for example, by spring bias.

After having entered into the machine aisle, the electric overhead conveyor may be uncoupled from the chain link train, and be moved to a next chain link train, which can then be brought in like manner, after a corresponding coupling, to the processing stations in a further machine aisle. This procedure may be repeated depending on the number of processing stations, or as needed, with the use of only one, in any event only a small number of electric overhead conveyors serving as a drive. An additional advantage consists in that this drive concept of a transport device for a textile machine allows to change an operating level without the use of an elevator.

This further development of the invention is based on the recognition that the rail of the electric overhead conveyor, and which has a circular course, may be arranged on a level above the floor, which is so high as to leave an adequate clearance between the lower ends of the carrying devices or hanging carriages and the floor for walking along the aisle below the electric overhead conveyor.

On the other hand, it is then possible to lay the rails of the separate guideway for the product carrying devices, so as to incline from the circular course downward into the machine aisle, and to extend there with their projecting package mandrels or receiving grooves as much as possible on the same level as the winding spindles of the takeup devices, so as to permit the empty tubes to roll downward to the takeup devices or the full yarn packages downward from the takeup devices.

Moreover, this arrangement has the advantage that, as a result of having the second guideway system extend downward into the machine aisle, the chain link train remains always taut, even when it is pushed into the machine aisle.

Advantageously, it is possible to connect the chain link train to the electric overhead conveyor via a continuous coupling chain. Such a coupling chain may be, for example, an articulated link chain, in particular a Cardan joint chain. The length of such a coupling chain may be dimensioned, so as to allow to position the transport devices for the full yarn package or empty tubes facing all processing stations of a machine front of the textile machine. This allows an optimal positioning of the chain link train, in which all processing stations can be serviced in a single position of the chain link train. Preferably, the coupling chain is provided at its end with a coupling element for joining the chain link train to the electric overhead conveyor. This also allows to achieve a simple and fast separation of the coupling chain from the chain link train, as soon as same has been transported to the intended track section, and when subsequently, after a corresponding uncoupling, another chain link trains is to be moved by means of the electric overhead conveyor.

BRIEF DESCRIPTION OF THE DRAWINGS

Some of the objects and advantages of the present invention having been stated, others will become apparent as the description proceeds, when considered in conjunction with the accompanying drawings, in which.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout, and unless otherwise specified, the following description will always apply to all Figures.

Figure 1:
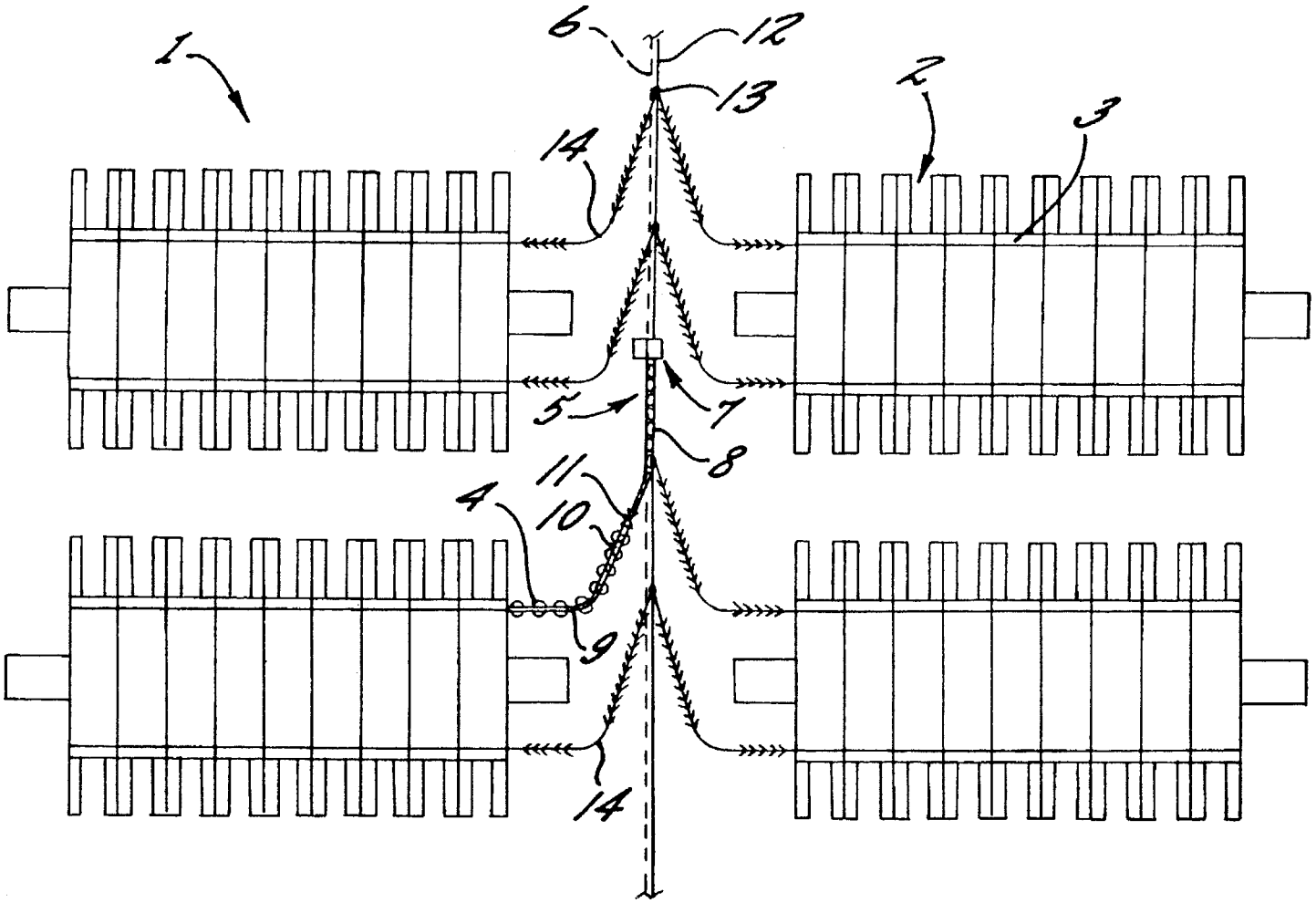
FIG. 1 is a schematic view of a transport device for a textile machine in accordance with the invention.

A textile machine 1, as shown by way of example in FIG. 1, comprises a plurality of processing stations 2 with machine aisles 3. The processing stations extend along a common machine front, which faces one of the machine aisles. To supply empty tubes to, or to remove full yarn packages 4 from the particular processing stations 2, a transport device 5 is used. This transport device 5 comprises a transport drive in the form of an electric overhead conveyor 7 traveling along a circular rail 6, in which switching elements are absent. Attached to this electric overhead conveyor, via coupling elements 11, is a coupling chain 8, which is constructed as a Cardan joint chain. Coupled to chain 8 via coupling element 11 is a product carrying device 9 which is in the form of an articulated chain link train 10 for carrying yarn packages 4. Each chain link train 10 travels along a main portion 12 of a guideway which extends parallel to the circular course of the rail 6 of the electric overhead conveyor 7. From this main portion 12 of the guideway, via corresponding switching elements 13, secondary side tracks 14 of the guideway branch off, which lead to the machine aisles 3 between processing stations 2. As indicated in this Figure, these secondary side tracks 14 may be constructed with upward or downward grades.

As a result of this invention, a single drive in the form of electric overhead conveyor 7, or at least, a small number of electric overhead conveyors 7, allows to move in a predetermined sequence to the particular processing stations 2 a number of chain link trains 10 corresponding to the requirements in each instance, which carry the empty tubes to be processed or the fully wound yarn packages 4. Thus, the use of a plurality of drives, as has been common practice until now, may be omitted, so that costs are reduced, and the susceptibility to breakdown is lessened as a whole. Stated otherwise, the electric overhead conveyor consists of only one transport drive, which may also be called the locomotive or tractor drive unit.

Figure 2:
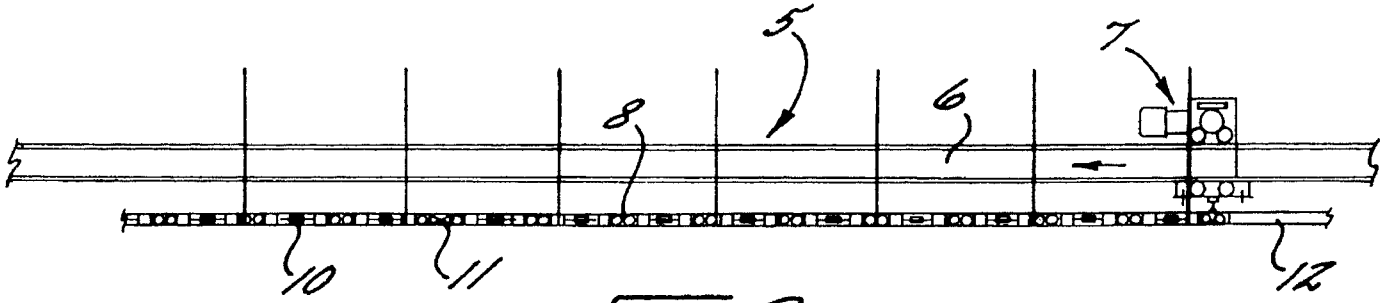
FIG. 2 is a top plan view of a section of a product transport system of the present invention and illustrating an electric overhead conveyor with a coupling chain and a chain link train.

As shown in FIG. 2, the coupling of a chain link train 10 with an electric overhead conveyor 7 as a drive means allows to accomplish an economic transportation of relatively closely spaced-apart yarn packages 4. The electric overhead conveyor may be associated with a coupling chain 8 in the form of a Cardan joint chain, which forms the connection to chain link train 10 via corresponding coupling elements 11. The coupling chain e may be varied in its length depending on requirements. The guideway 12, 14 supports and guides the chain link train 10. With respect to this guideway, it is possible to make the coupling chain 8 extremely variable, whereas the electric overhead conveyor 7 travels along a simple circular course or rail 6 without any switching elements. Thus, depending on need and necessity, the electric overhead conveyor 7 moves, via coupling chain 8, the chain link train 10 in the fashion of a locomotive within the guideway 12, 14.

Figure 3:
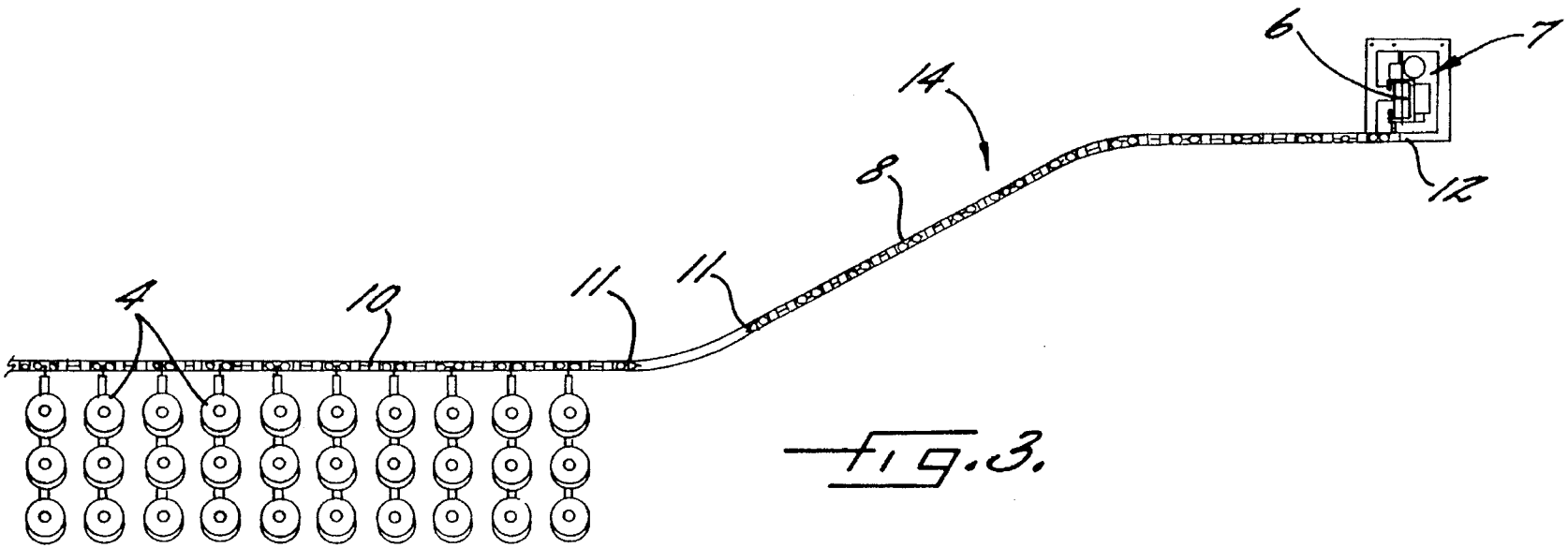
FIG. 3 shows an electric overhead conveyor with coupling chain and a chain link train to be connected thereto positioned on a side track of the guideway at a processing station.

As best shown in FIG. 3, it is thus possible to move a chain link train 10 of a certain length with electric overhead conveyor 7 and coupling chain 8 to a processing station 2 located outside of the main portion 12 of the guideway, or to a parking or temporary storage zone along side tracks 14, in that chain link train 10 is pushed or pulled to the desired position by coupling chain 8 which is driven by electric overhead conveyor 7. The attachment of electric overhead conveyor 7 to coupling chain 8 furthermore allows to easily overcome grades and to pass through narrow curves.

Figure 4:
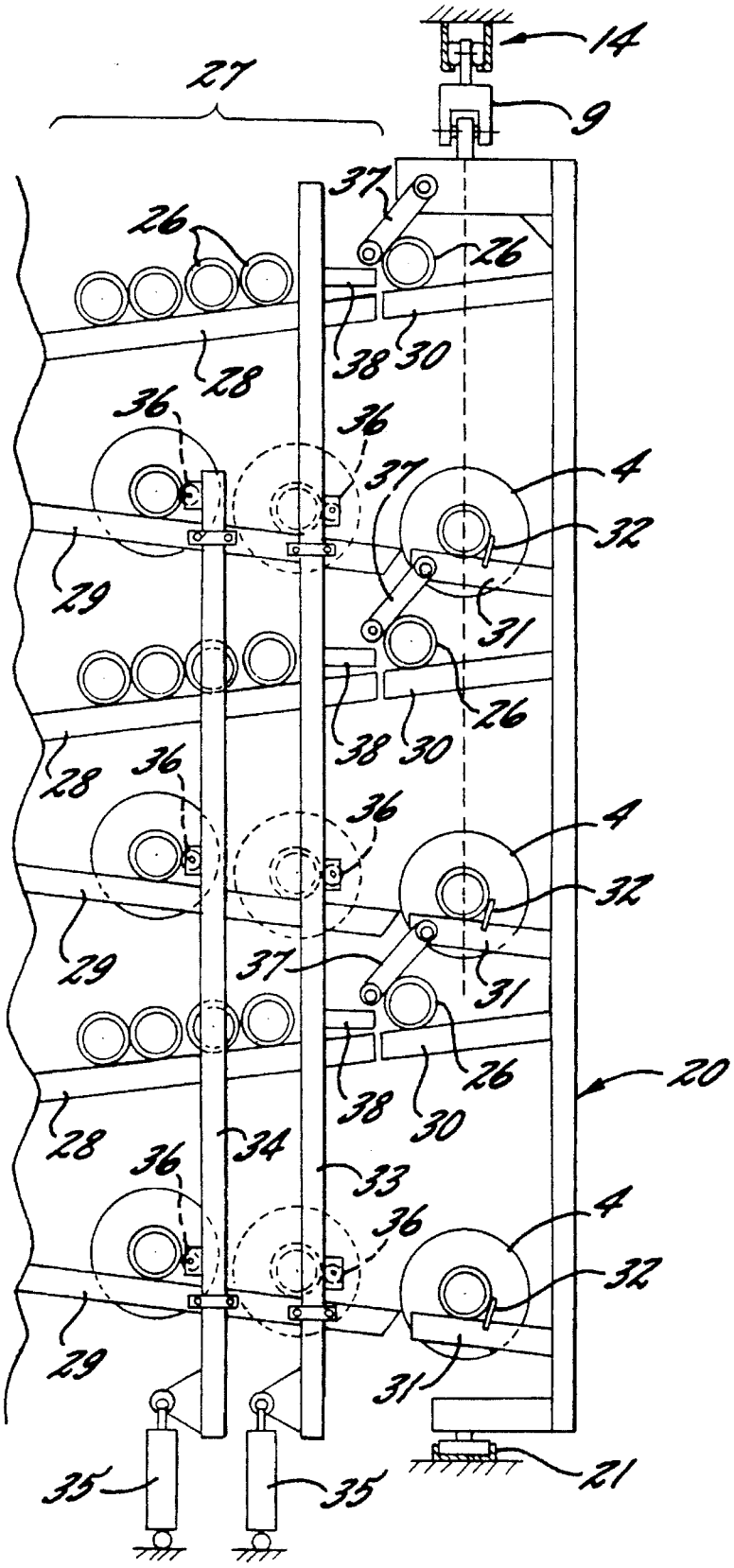
FIGS. 4 and 4*a* are each a fragmentary side elevation view of a hanging carriage of the chain link train positioned in front of the machine.
Figure 4A:
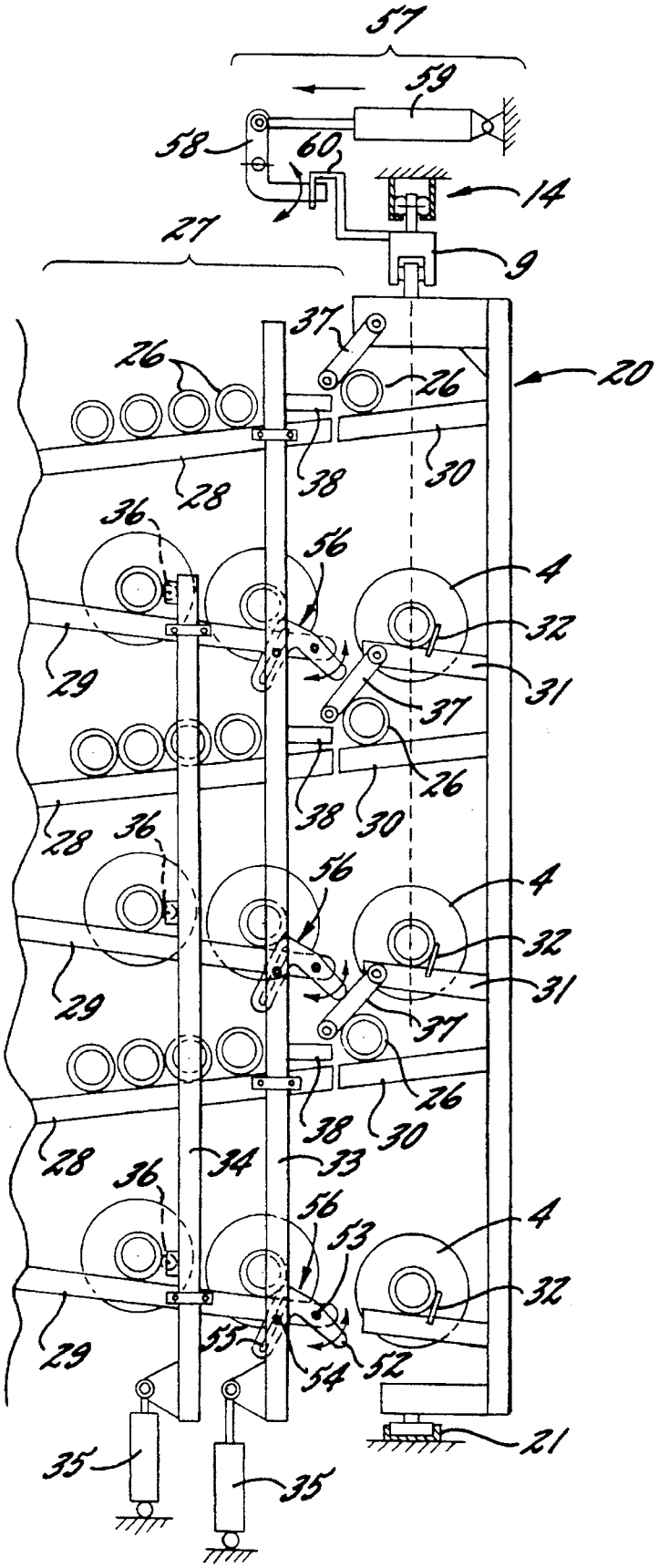

FIGS. 4 and 4*a* illustrate, how an element of the chain link train services a yarn winding device associated thereto. As illustrated, a hanging carriage 20 is supported at its upper end for movement by means of carrying device 9 along secondary side track 14, which leads into the particular machine aisle.

The hanging carriage comprises a plurality of individual levels. Each of these levels is used to either store empty tubes 26 or full yarn packages 4. All levels serving the same purpose are identical to each other and have the same vertical spacing between one another. The empty tubes 26 or the full yarn packages 4 lie with the outer ends of the tubes on supports, which are each inclined in a certain manner and form the levels.

Figure 6:
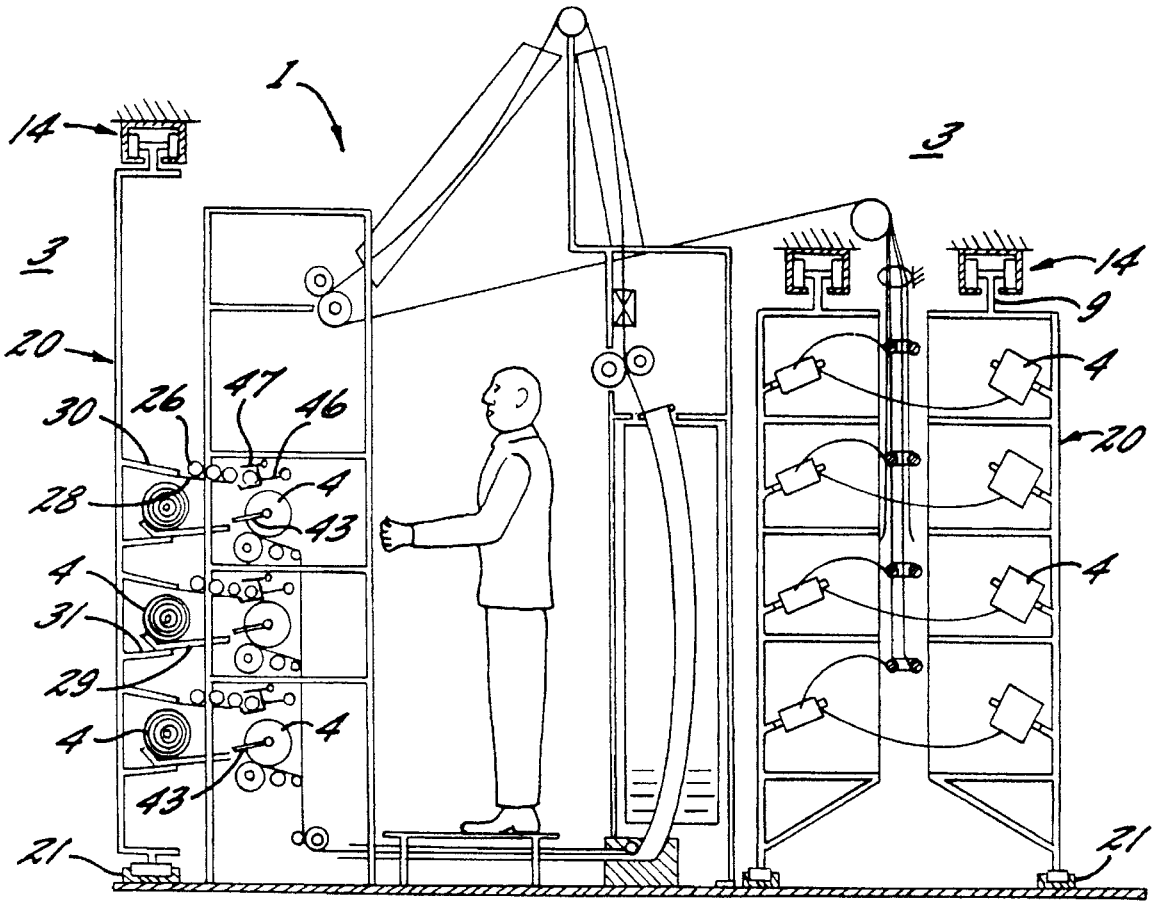
FIG. 6 is a side elevation view of a textile machine looking along the machine aisles and with the product transport devices serving as feed yarn package creels.

In the illustrated view, the machine front is to the left of the break line. There, the individual yarn winding units are vertically superposed, as is shown in the embodiment of FIG. 6.

The arrangement of the levels of hanging carriage 20 corresponds substantially to the arrangement of the yarn winding units of the machine front.

Arranged between the machine front and the hanging carriage, is a so-called intermediate frame 27, which arranges the transfer of new empty tubes from hanging carriage 20 to the particular yarn winding unit, and likewise the transfer of the finished, full yarn packages 4 from the yarn winding units to the hanging carriage.

To this end, the intermediate frame 27 is provided with ramps 28, 29, which connect substantially without a transition to the inclined levels of hanging carriage 20. The inclination of the levels of hanging carriage 20 corresponds substantially to the inclination of ramps 28, 29, and the levels can be positioned in alignment with the respective ends of ramps 28, 29.

Furthermore, a support 30 holding empty tubes 26 is arranged above each support 31 associated thereto and accommodating full yarn packages 4. This means that the empty tubes of each overlying level are supplied via associated ramps 28 to the yarn winding units, where they are received by package supports so as to be wound. Subsequently, the fully wound yarn packages 4 are released from the package supports and delivered via the respective ramps 29 to supports 31 for the full yarn packages. There, the full yarn packages roll against a stop 32, so as to be secured in their position, while they are transported by hanging carriage 20. Preferably the stops engage on each tube end projecting beyond the ends of the packages.

In the illustrated position of hanging carriage 20 in front of the textile machine, the hanging carriage 20 is precisely secured in its position, at its upper end by carrying device 9, and at its lower end by a U-shaped positioning rail 21, so that the ends of the supports 30, 31 are only slightly spaced from the adjacent ends of ramps 28, 29. Basically, the U-shaped positioning rail 21 may extend over the entire length of secondary side track 24 and parallel to same. On the other hand, it may consist of a length of rail, which is arranged only in the region in front of the textile machine.

As is shown in the embodiment of FIG. 4*a*, the hanging carriage 20 may be provided with a locking device 57, which centers the hanging carriage 20 in its position in front of the winding machine. In the present embodiment, the locking device 57 consists of an elbow lever 58, which is movable by a piston-cylinder unit 59. With its free end, the elbow lever 58 engages in a corresponding centering catch 60 of hanging carriage 20, and thus avoids that, in the axial direction of secondary side track 14, the hanging carriage is not positioned exactly in front of the textile machine. In the present embodiment, the centering catch 60 consists of a U-shaped or V-shaped strap, which is fixedly connected to hanging carriage 20. The free end of elbow lever 58 engages in this strap, as soon as the carriage 20 is properly positioned.

In the present embodiment, the locking device is arranged at the upper end of hanging carriage 20. However, depending on the installed situation, it may also be located at the lower end of hanging carriage 20 or also at other places.

Furthermore, the opportunity presents itself to guide the hanging carriage 20 in U-shaped positioning rail 21 by means of two rolls one succeeding the other in the longitudinal direction of the machine. This allows to reliably prevent the hanging carriage 20 from turning unintentionally.

Furthermore, it is essential that the unloading of empty tubes 26 and the transfer of full yarn packages 4 occur in a controlled manner. To this end, different control devices are shown. In the embodiment of FIG. 4, vertically displaceable control mechanisms 33, 34 are provided, which are actuated in their direction of movement by corresponding piston-cylinder units 35. Each of the control mechanisms 33, 34 possesses at the roll-off height of the projecting end of the associated winding tube a stop 36, which allows to stop the advancing winding tube, first, in the illustrated position of control mechanism 34, which is reached first in the roll-off direction. The stop may be constructed as a rotatably supported ball bearing, so that the kinetic energy of the advancing full yarn package is first converted into mere rotational energy, and then is evenly slowed down.

Once each of the ramps 29 has received a full yarn package in the position illustrated in solid lines, the control mechanism 34, which comes first in the roll-off direction, is opened by means of piston-cylinder unit 35, whereas the control mechanism 33, which is reached thereafter, when viewed in the roll-off direction, remains in its illustrated and closed position. Subsequently, the full yarn packages roll to the position shown in dashed lines, which is defined in corresponding manner by the second control mechanism In the meantime, the package lever 43 of the yarn winding device, as shown in FIG. 6, has received a further empty tube 26, so that basically a further empty tube 26 is permitted to roll from hanging carriage 20 onto the corresponding ramp 28.

However, pivotally supported empty tube stops 37 are still in front of empty tube 26 being on standby, and prevent same from rolling off. These empty tube stops are actuated by second control mechanism 33, as soon as same is set into motion by the corresponding piston-cylinder unit 35. To this end, the second control mechanism 33 possesses spaced apart stops 38, whose path intersects with the free end of empty tube stops 37. As can be noted, a vertical upward movement of stops 38 will cause empty tube stops 37 to move upward, so that the empty tubes 26 having been retained, are now able to reach the corresponding ramps 28.

At the same time the full yarn packages 4 being in the position shown in dashed lines are released, in that the stops 36 of second control mechanism 33 are moved out of the roll-off path of the laterally projecting tube ends.

Accordingly, the performance of the second control mechanism 33 is based on a double function, since same realizes both the release of new empty tubes and the release of full yarn packages 4 waiting for their removal.

After the hanging carriage 20 has thus been freed of the carried-along empty tubes 26 and received the new full yarn packages 4, the latter can be removed in the above-described manner.

As a distinction from the embodiment of FIG. 4, FIG. 4*a* illustrates other possible control mechanisms. In this embodiment, the intermediate frame 27 is provided with an extension 52, which is rotatable about an axis 53 extending parallel to the longitudinal axis of the yarn package and arranged at that end of ramps 29, which faces package receiving level 31 on hanging carriage 20.

The axis of rotation extends such that when the free end of rotatable extension 52 is swung downward, namely that end facing hanging carriage 20, the opposite end of rotatable extension 52 is raised so far that the full yarn package being shown in a standby position rolls toward this free end.

Thus, a barrier is formed, which prevents an unintentional rolling of the full yarn packages toward hanging carriage 20.

Consequently, in this one rotated position as illustrated, the rotatable extension 52 closes ramp 29. In the other possible end position of rotatable extension 52, same is in alignment with its free end facing the full yarn package level on hanging carriage 20, and its other end is aligned with the remainder of ramp 29, so as to create for the advancing full yarn package a continuous possibility of rolling off.

Although in the illustrated embodiment of FIG. 4*a* the first control mechanism 34 is not needed, it may yet be provided for singling the full yarn packages as they roll along. To actuate the rotatable extension 52, the second control mechanism 33 is used, which engages with a corresponding pin 54 in an oblong hole 55 of rotatable extension 52. To this end, the oblong hole 55 is provided in an angularly projecting rocking lever 56 of rotatable extension 52.

Consequently, the pin is movable in the axial direction of second control mechanism 33, while it is simultaneously engaged in oblong hole 55. This allows to impart in an upward movement of control mechanism 33 a motion to rotatable extension 52, which basically moves same to a blocking position, while at the same time stop 38 eliminates the effect of empty tube stop 37. Accordingly, it applies also to this embodiment that the second control mechanism 33 fulfills the aforesaid double function.

Important in these systems is that both empty tubes and full yarn packages are able to roll automatically, each by their gravity, along supports 30, 31 and adjacent ramps 28, 29. In each instance, the rolling motion is realized by a coordinated cooperation between control mechanisms 33, 34 (FIG. 4), or control mechanism 33 only (FIG. 4*a*), in combination with stops 36 and 38 (FIG. 4) or stop 38 only (FIG. 4*a*).

As to further details, reference is made to FIG. 6.

Figure 5:
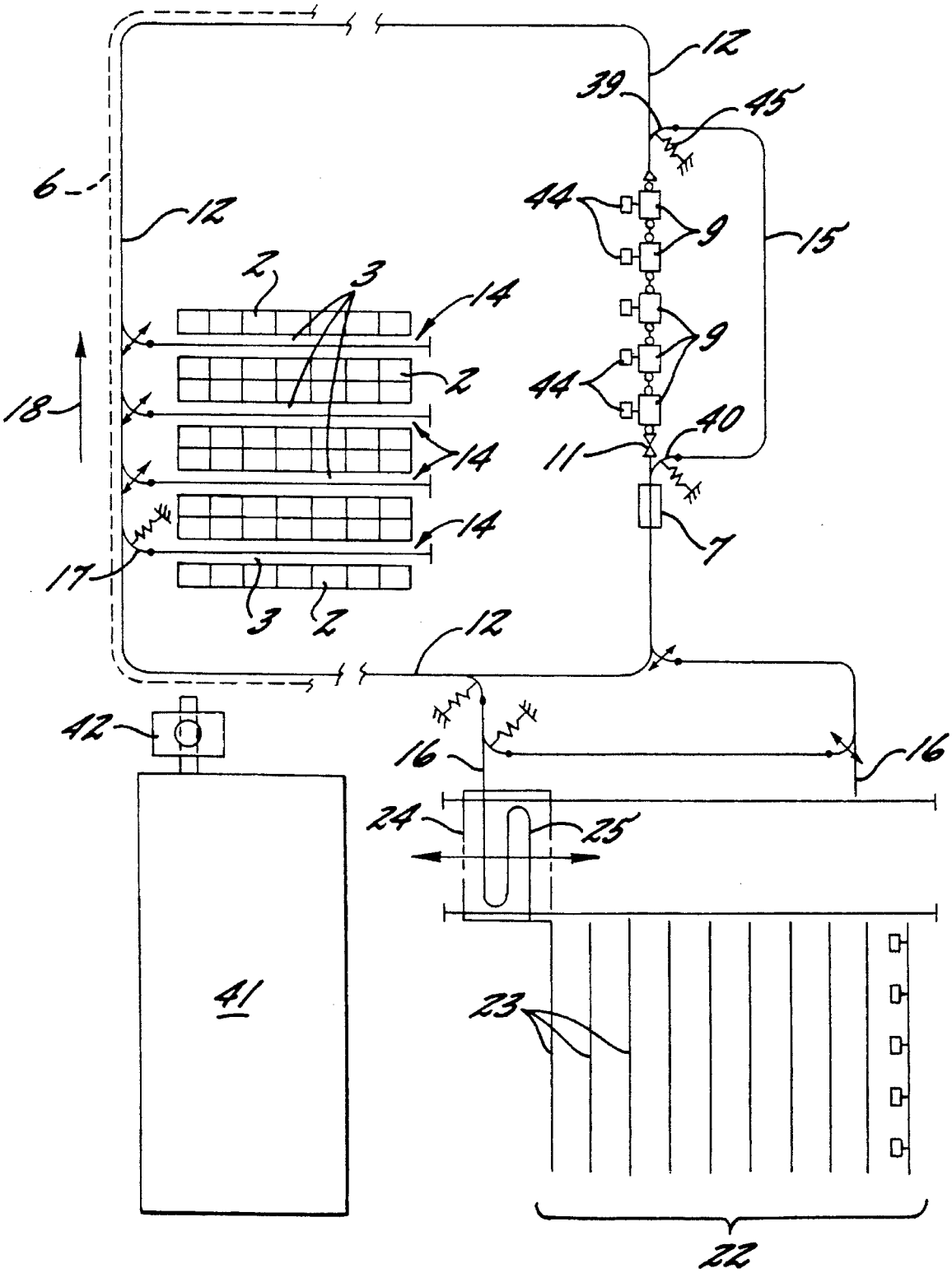
FIG. 5 is a schematic floor plan view of a textile machine in accordance with the present invention.

FIG. 5 is a floor plan view of a textile machine in accordance with the present invention. Supplementing the foregoing description, the Figure shows a textile machine having four machine aisles 3. It is understood that a large number of such machine aisles may be arranged parallel to one another.

Arranged in each of the machine aisles is a secondary side track 14 of the guideway, which branches off from a main track 19 of the guideway for the product conveying devices 9. The main portion 12 extends substantially parallel to the rail 6 of the electric overhead conveyor, a portion of which is shown in dashed lines in FIG. 5. The main travel direction of the electric overhead conveyor and associated tractor drive unit is indicated at 18. Accordingly, the electric overhead conveyor travels along a circular, closed-loop course, and couples a chain link train, as need arises.

The processing stations 2 are arranged side by side along the machine aisles, and present thus a closed machine front, along which a plurality of yarn winding devices are arranged side by side and on top of one another in vertical direction.

Two machine fronts facing one another, also named A or B sides of the machine aisle, can be serviced from a single machine aisle.

In the present embodiment, a turning or looping track 15 is arranged outside the region of the machine, which permits to turn around carrying devices 9 such that when they move out of the area of the turning track, they point with their package mandrels 44 always in the required direction. In a corresponding application of the embodiment shown in FIG. 4, this applies also to the alignment of the therein illustrated receiving levels for the full yarn packages.

The chain link train arriving in main travel direction 18 either is allowed to pass unhindered at turning track 15, or it reversed in its travel direction upon passing an entry switch 39 to turning track 15, and it is thus moved to the turning segment of the turning track. In so doing, the orientation of the full yarn packages is reversed, and the full yarn packages may again leave with a reversed package orientation upon passing exit switch 40 of turning track 15.

In the present application, such forcibly controlled switches 39, 40 are uniformly illustrated with a pressure spring 45. The illustration of these forcibly controlled switches corresponds to the illustration of entry switch 39 leading to the turning track.

Controllable switches may also be employed, in which the position of the switch tongue is controlled by a precontrolled actuating mechanism, so as to define the position of the switch either in the one or the other end position. These switches are shown each with a double arrow pointing to the two possible setting directions (note, for example, the switches at the entry ends of the machine aisles).

As regards the switches of the turning track, it is essential that the entry switch 39 points in the main travel direction 18 to the throughgoing length of the main portion 12 of the guideway. In this instance, the entry switch 39 may be provided with a tongue, which rests resiliently biased always against throughgoing main portion 12 of the guideway. The chain link train, as it passes by, opens the switch itself, when traveling over entry switch 39, until the last element of the chain link train has passed the switch. It is thus possible to use a forcibly controlled switch, which does not require an additional switch actuating mechanism.

Should the full yarn packages be already correctly oriented in the main travel direction 18 of the arriving chain link train, and should the tractor drive unit of the electric overhead conveyor be already coupled to the rear end of the chain link train, the latter can be pushed straight ahead without passing through turning loop 15. In this instance, the exit switch 40 is likewise self-opening in the above-described manner, so that also here no further control is required.

This characteristic of the switch arrangement in connection with turning loop 15, and the fact that the spacing between the entry switch 39 and the exit switch 40 is greater than the length of a chain link train, allow to move the tractor drive unit of the electric overhead conveyor without many resources from a position in front of the train to a position behind the train, in that it is detached from the train, after same is positioned between entry switch 39 and exit switch 40, so as to then travel along the circular course behind the train, where it is reattached.

This is advantageous, so as to be able to push the train into a stationary temporary storage 22. It is therefore not necessary to provide a track for the electric overhead conveyor to exit from the temporary storage, since the electric overhead conveyor does not even enter into temporary storage 22.

The temporary storage 22 comprises a plurality of parallel arranged parking track sections 23, which terminate with their ends in a common horizontal plane of temporary storage 22. Several of these parking track sections 23 may be arranged horizontally or vertically to one another. To move the storage trains from main portion 12 of the guideway into the stationary temporary storage 22, so-called unilaterally approachable transfer track sections 16 are used, which branch off from main portion 12 of the guideway.

These unilaterally approachable transfer track sections 16 each terminate in a horizontal or vertical position, which extends basically in the same plane as the horizontal plane of parking track sections 23.

To move the storage trains into the stationary temporary storage 22, a so-called shuttle transport device 24 is used. Such a shuttle transport device 24 is provided for each level of parking track sections 23. The shuttle transport device is adapted for back and forward movement only in a horizontal plane. It can in each instance be positioned, so that the associated transport railway 25 of shuttle transport device 24 is aligned at its one end with side track 16, and at its other end with the free end of parking track sections To construct the shuttle transport device as compact as possible, the transport railway 25 is curved several times in S-shape, in such a manner, however, as to permit the chain link train to move easily onto parking rail After the chain link train is transferred to shuttle transport device 24, same moves along its horizontal plane of movement so far as to be able to push the received chain link train onto a corresponding parking track section 23 in temporary storage 22, and to detach it there.

The temporary storage 22 serves to temporarily store the full yarn packages for a certain period of time, for example, when the operation in packing area 41 is not continuous in a 24-hour period. Thus, a certain buffering or temporary storage of the yarn packages occurs, which is always necessary, when finish processing of the full yarn packages in a continuous operation is not possible or not necessary.

Essential for stationary temporary storage is that the length of its parking track sections allows to accommodate at least one chain link train. Other lengths may be considered, which allow to accommodate an integral multiple of chain link trains.

In any event, the parking track sections are associated to the second separate guideway system, so that the chain link train can be pushed by the electric overhead conveyor onto a parking track section 23. Thereafter, the coupling chain may be detached by releasing coupling elements 11 between electric overhead conveyor 7 and carrying devices 9, and the tractor drive unit of the electric overhead conveyor is available for the next transport order.

The removal of the chain link trains from the storage occurs in reversed manner. To this end, each chain link train is pulled out of the temporary storage onto shuttle transport device 24.

To do so, the electric overhead conveyor 7 is connected to the parked chain link train after the startup of shuttle transport device 24, and same is then removed from temporary storage 22 via transport railway 25. Thereafter, the chain link train can be delivered by the shuttle transport device 24 to an unloading robot 42. There, the transport devices are freed of full yarn packages 4, which are then presorted, inspected, packed, and delivered to shipping in packaging area 41.

A special advantage of this embodiment of the invention is based on that the main portion 12 of the guideway arranged in front of stationary temporary storage 22 and likewise the unilaterally approachable transfer track sections 16 may be adapted without any additional expenses to the multilevel temporary storage 22.

To this end, it is only necessary to lay the main portion 12 of the guideway with an upward or a downward grade in front of the temporary storage, corresponding to the overall height of all levels across the width of the temporary storage, so that the main portion 12 of the guideway lies with its two ends at the different levels of the temporary storage. When now each of the transfer track section 16 branches off at the height, at which the corresponding level of the parking track sections extends, the correct level of parking track sections 23 is automatically approached via only a single upward or downward sloping length.

However, it should be remarked that in the place of upward and downward sloping lengths, the shuttle transport device 24 may be designed and constructed for movement not only in the horizontal, but also in the vertical direction.

Shown in FIG. 6 is a side view of a textile machine with a view into the two machine aisles 3. Such a textile machine has a first aisle 3 (right-hand portion of the Figure), in which the full yarn packages 4 are accommodated in feed yarn package creels. The individual yarns are unwound from the supply packages, processed (for example, textured), and subsequently again wound. The winding or takeup occurs in the second aisle 3 (in the left-hand portion of the Figure).

Here, the feed yarn package creel is formed by the hanging carriages 20. Thus, the feed yarn creel becomes a component part of the second guideway system, whose secondary side tracks 14 enable the supply and removal of hanging carriages 20 to or from the machine aisles 3.

In this arrangement, the feed yarn creel is likewise stationarily held at the bottom of a U-shaped positioning rail 21, so that despite its movability and thus for the rapid replacement of yarn packages a stationary feed yarn creel is obtained.

The significant advantage of this further development lies in the short time that is required to replace feed yarn packages, when, for example, the full yarn packages have been completely unwound. Therefore, it is possible achieve short interruptions in the production.

This advantage is accomplished in that the feed yarn package creel can be fully loaded already outside the machine aisle, so that it only needs to be replaced as a whole.

Further shown is how the empty tubes 26 are exchanged for full yarn packages 4 in the winding region of the illustrated textile machine in the machine aisle 3 shown on the left. Although reference is made to FIG. 4, it can however noted in addition that the arriving empty tubes 26 are removed by means of a gripper 46 from the free end of ramp 28. In so doing, the empty tubes are singled by means of a dropping blocking lever 47.

Since the path of movement of gripper 46 intersects the path of movement of package lever 43, it is possible to transfer the empty tube from gripper 46 to the package lever in the region of their common intersection.

Moreover, the package lever 43 can be moved unhindered in direction toward ramp 29 so far that it is able to remove from the direct winding region, with its centering plates laterally engaging into the tube ends, the package clamped therebetween, and to deposit it on the ramp. An axial spreading of the centering plates allows to release the yarn package, and it can then be transported away on hanging carriage 20.

Figure 7:
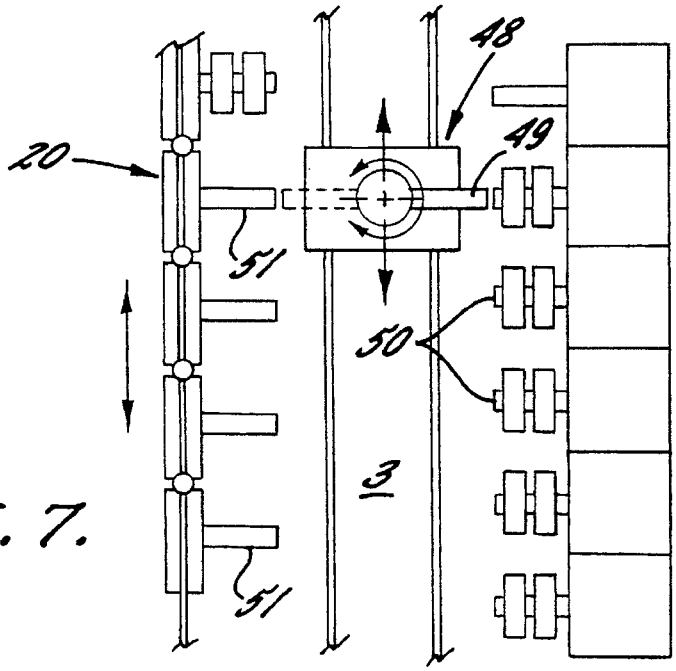
FIG. 7 is a schematic top view of a product transport device with a doffer for servicing a feed yarn package creel and winding position.

While in the embodiment of FIG. 6 the hanging carriage 20 cooperates directly with the processing stations of textile machine 1, the embodiment of FIG. 7 uses a doffer 48.

Such a doffer 48 travels along the machine front, and is provided, for example, with a doffer arm 49 which is rotatable in a horizontal plane. For example, the doffer arm 49 is arranged at the same height as individual winding spindles 50, which are directed into machine aisle 3. In any event, the doffer arm 49 is aligned and positioned in front of a winding spindle 50, so as to permit to push the full yarn packages from the winding spindle onto the doffer arm.

For the sake of simplicity, it is also possible to arrange the spindles 51 of hanging carriages 20, so as to permit the doffer 48 to remove the full yarn packages from winding spindles 50, and to position its arm for purposes of facing the carriage spindle 51 by rotating about its vertical axis. There, the just-received full yarn packages are removed by pushing, and the next takeup position can be serviced.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A textile yarn processing apparatus comprising a textile machine having a plurality of yarn winding stations positioned in a side-by-side arrangement extending in a longitudinal directional along a front face of the machine, a product transport system for transporting products to or from the winding stations of the textile machine and comprising a) an overhead guideway comprising a main track portion (12) which extends generally perpendicularly to the longitudinal direction of the machine and a side track portion (14) which extends longitudinally along the front face of the machine, b) a product carrying device (9) mounted for movement along both of said portions of the guideway, c) an overhead rail (6) having a portion extending adjacent and parallel to said main track portion of said guideway, and characterized by the absence of any portion of said overhead rail extending adjacent and parallel to said side track portion of said guideway, d) a tractor drive unit (7) mounted for powered movement along said overhead rail, and e) a coupling unit (8) for releasably coupling the tractor drive unit to said product carrying device.

2. The apparatus as defined in claim 1 wherein said guideway further comprises switch means (17) interconnecting the main track and side track portions so as to permit the product carrying device to enter the side track portion from the main track portion in either direction of movement along the main track portion.

3. The apparatus as defined in claim 2 wherein said side track portion (14) of said guideway terminates in a dead end at an end thereof opposite said switch means (17).

4. The apparatus as defined in claim 1 wherein said product carrying device comprises a plurality of separate elements which are joined to each other in the manner of an articulated link chain (10), and wherein each separate element includes a plurality of supporting devices for yarn packages.

5. The apparatus as defined in claim 1 wherein said releasable coupling unit comprises an elongate chain which is supported in the overhead guideway.

6. The apparatus as defined in claim 1 wherein said side track portion (14) of said guideway extends at a height below that of said main track portion (12).

7. The apparatus as defined in claim 1 wherein said main track portion of said guideway includes a looping track segment (15).

8. The apparatus as defined in claim 1 wherein said main track portion (12) of said guideway includes at least one transfer track portion (16) branching therefrom.

9. The apparatus as defined in claim 8 further comprising a temporary storage (22) and which includes a plurality of parking track portions (23) of said guideway, with the parking track portions having forward ends which terminate in a common vertical plane, and further comprising a shuttle transport device (24) mounted for movement along a railway (25) which is parallel to said common plane, and adjacent said transfer track portion (16), such that the shuttle transport device is adapted to move product carrying devices between said transfer track portion and any one of said parking track portions.

10. The apparatus as defined in claim 1 wherein said switch means (17) is self-opening when the product carrying device moves thereacross in a main travel direction on said main track portion of said guideway, and includes switch tongues which are resiliently biased against said main track portion.

11. The apparatus defined in claim 1 wherein said product carrying device (9) includes hanging carriages (20), and means for securing the carriages in front of each of said yarn winding stations of said textile machine.

12. The apparatus as defined in claim 1 further comprising a temporary storage (22) for said product carrying devices, and which includes at least one parking track portion (23) of said guideway.

13. The apparatus as defined in claim 1 wherein said product carrying device (9) is constructed and arranged as a moveable creel, which is adapted to be moved loaded with yarn packages (4) along the front face of the machine.

14. The apparatus as defined in claim 1 further comprising a doffing apparatus mounted for movement in a longitudinal direction along the front face of the textile machine, and wherein said side track portion of said guideway is spaced from said machine front face a distance sufficient to permit the doffing apparatus to move between the machine front face and the product carrying device for servicing the yarn winding positions.

15. The apparatus as defined in claim 1 further comprising an intermediate frame (27) arranged between said package carrying device (9) and the front of the machine and including means for supporting at least one full yarn package and at least one empty bobbin tube.

16. The apparatus as defined in claim 15 wherein said supporting means includes a first ramp (29) for supporting the at least one full yarn package which is inclined away from the machine front face, and a second ramp (28) for supporting the at least one empty bobbin tube which is inclined toward the machine front face.

17. The apparatus as defined in claim 16 wherein said intermediate frame further comprises means for controlling the movement of the at least one full yarn package and the at least one empty bobbin tube along their respective ramps.

18. The apparatus as defined in claim 17 wherein said movement controlling means comprises a pair of vertically displaceable actuating rods (33,34), with at least one of said rods being positioned adjacent the associated ramps so as to selectively engage the at least one full yard package so as to limit its movement along the inclined first ramp.

19. The apparatus as defined in claim 18 wherein said movement controlling means further comprises an extension (52) which is rotatably mounted at the end of said first ramp (29) which faces away from the front of the textile machine and which is rotatable between one rotated position forming a roll-off barrier for the at least one full yarn package and a nonbarrier in another rotated position, and wherein one of said actuating rods is connected to said extension for controlling movement thereof between said positions.

20. The apparatus as defined in claim 15 wherein said package carrying device (9) includes a first package support (31) aligned with said first ramp (29) of said intermediate frame, and a second bobbin tube support (30) aligned with said second ramp (28).

21. The apparatus as defined in claim 1 wherein said coupling unit is mounted for movement along both said main track portion and said side track portion of said guideway.

22. The apparatus as defined in claim 1 wherein said overhead rail, said tractor drive unit, and said coupling unit are configured so as to be adapted to move the product carrying device along the full extent of said guideway without the use of supplemental drives.

23. A textile yarn processing apparatus comprising a plurality of textile machines positioned parallel to each other so as to define a plurality of longitudinally directed aisles between adjacent machines, and with the textile machines having machine ends which are generally aligned in a transverse direction which is perpendicular to the longitudinal direction, a product transport system for transporting products to or from the winding stations of the textile machine and comprising (a) an overhead guideway comprising a main track portion (12) which extends along the ends of said machines in said transverse direction, a side track portion (14) which extends longitudinally along each of said aisles, and switch means connecting each of said side track portions to said main track portion, (b) a product carrying device ( 9 ) mounted for movement along all of said portions of the guideway, (c) an overhead rail (6) having a portion extending adjacent and parallel to said main track portion of said guideway, and characterized by the absence of any portion of said overhead rail extending adjacent and parallel to any of said side track portions of said guideway, (d) a tractor drive unit (7) mounted for powered movement along said overhead rail, and (e) a coupling unit (8) for releasably coupling the tractor drive unit to said product carrying device.

24. The apparatus as defined in claim 23 wherein said coupling unit is mounted for movement along both said main track portion and each of said side track portions of said guideway.

* * * * *